US005185993A

United States Patent [19]

Fritschi et al.

[11] Patent Number: 5,185,993

[45] Date of Patent: Feb. 16, 1993

[54] SPINNING MACHINE HAVING A PEG TRAY CONVEYOR

[75] Inventors: Isidor Fritschi, Andelfingen; Urs Keller, Seuzach; Markus Erni, Winterthur; Urs Meyer, Niederglatt; Jorg Wernli, Winterthur, all of Switzerland

[73] Assignee: Rieter Machine Works, Ltd., Winterthur, Switzerland

[21] Appl. No.: 499,379

[22] PCT Filed: Sep. 21, 1989

[86] PCT No.: PCT/EP89/01098

§ 371 Date: Jul. 5, 1990

§ 102(e) Date: Jul. 5, 1990

[87] PCT Pub. No.: WO90/03461

PCT Pub. Date: Apr. 5, 1990

[30] Foreign Application Priority Data

Sep. 24, 1988 [CH] Switzerland ..... 03547/88

[51] Int. Cl.[5] ..... D01H 9/10; D01H 9/00

[52] U.S. Cl. ..... 57/281; 57/90; 57/266; 57/276; 242/35.5 A

[58] Field of Search ..... 57/281, 90, 276, 266; 242/35.5 A

[56] References Cited

U.S. PATENT DOCUMENTS

| | | | |
|---|---|---|---|
| 3,382,659 | 5/1968 | Schulz et al. | 57/276 |
| 3,788,054 | 1/1974 | Haussmann et al. | 57/266 X |
| 3,905,184 | 9/1975 | Takai et al. | 57/261 X |
| 4,432,198 | 2/1984 | D'Agnolo | 57/266 |
| 4,548,029 | 10/1985 | Araki et al. | 57/281 X |
| 4,813,222 | 3/1989 | Fukuda et al. | 57/281 X |
| 4,841,720 | 6/1989 | Kawasaki et al. | 57/276 X |
| 4,875,572 | 10/1989 | Kiriake | 57/276 X |
| 4,964,269 | 10/1990 | Dinkelman | 57/90 X |
| 5,056,726 | 10/1991 | Wirtz et al. | 242/35.5 R X |

FOREIGN PATENT DOCUMENTS

| | | | |
|---|---|---|---|
| 0061432 | 9/1982 | European Pat. Off. . | |
| 0355887 | 2/1990 | European Pat. Off. | 57/266 |
| 0418418 | 3/1991 | European Pat. Off. | 57/281 |
| 3544560 | 7/1986 | Fed. Rep. of Germany . | |
| 3712027 | 10/1987 | Fed. Rep. of Germany . | |
| 3637172 | 5/1988 | Fed. Rep. of Germany . | |
| 1085332 | 3/1989 | Japan | 57/281 |
| 1168638 | 10/1969 | United Kingdom . | |

OTHER PUBLICATIONS

Patent abstracts of Japan vol. 4 Nos. 3 (C-143) [1148], Jan. 1983.

*Primary Examiner*—Daniel P. Stodola
*Assistant Examiner*—William Stryjewski
*Attorney, Agent, or Firm*—Francis C. Hand

[57] ABSTRACT

A ring spinning machine comprises at least one group of spinning stations or points (11) arranged adjacent each other at equal intervals, a bobbin change device (14) for simultaneous replacement of full bobbins (15) spooled with yarn by empty bobbins (16) at each spinning point (11) and an endless conveyor (17) which extends along the spinning points (11) and is led from one end of the spinning point group (12) to the other back on itself and on which at the interval of the spinning points (11) upright bobbin pegs (13) are arranged in such a manner that in a bobbin change position of the endless conveyor (17) each spinning point (11) is exactly aligned with a bobbin peg (13) associated individually therewith. Each bobbin peg (13) is arranged on its own peg support tray (18). Associated with each peg tray (18) is a driver (19) which is adapted to be brought into entraining engagement therewith and which is disposed on the endless conveyor (17) in such a position that when the driver (19) is in entraining engagement with the associated peg tray (18) the bobbin peg (13) of said peg tray (18) in the bobbin change position of the endless conveyor (17) is exactly aligned with the associated spinning point (11).

17 Claims, 10 Drawing Sheets

SPINNING MACHINE HAVING A PEG TRAY CONVEYOR

Figure 1:
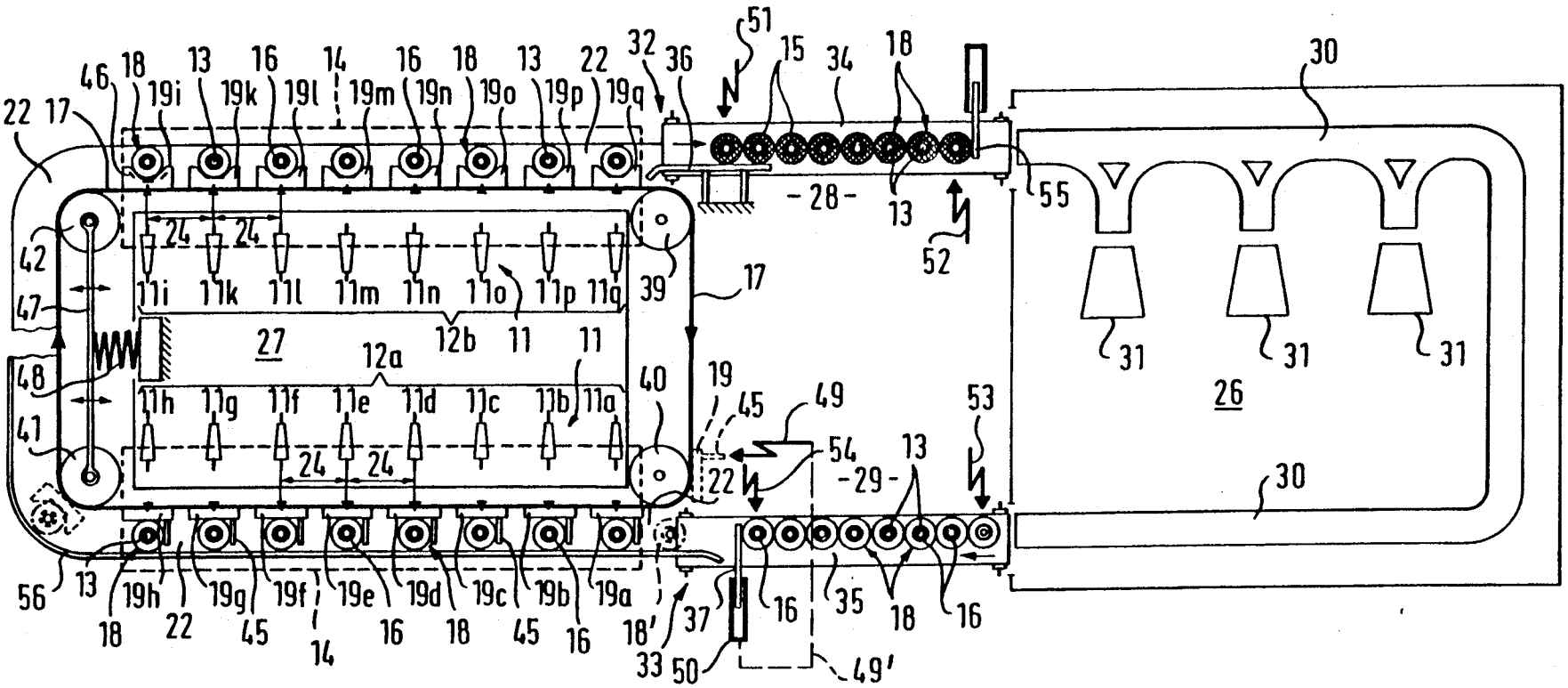

The invention relates to a spinning machine.

In a known ring spinning machine of this type (GB-PS 1,168,638) the bobbin pegs are mounted directly on the endless conveyor constructed as horizontal conveyor belt. The endless conveyor is generally constructed as a steel band or belt which distorts as little as possible so that the predetermined intervals of the bobbin pegs, which must coincide exactly with the intervals of the spinning points or stations, remain unchanged even on relatively long operation of the machine.

Whereas in the ring spinning machine according to GB-PS 1,168,638 the bobbin pegs are arranged at half the interval of the spinning stations or points in order to be able to receive during doffing temporarily simultaneously an empty bobbin and a full bobbin (cops) of the associated spinning point, it is also possible to provide on the endless conveyor constructed as a belt or band bobbin pegs only at the interval of the spinning points, in which case at each spinning point an additional peg must then be provided in order to receive temporarily one of the bobbins to be replaced on a bobbin change (U.S. Pat. No. 3,905,184).

It is further already known (EP-A-0 061 432) to provide on each machine side of a ring spinning machine or frame an endless conveyor, both runs of each endless conveyor being equipped with bobbin pegs so that when changing a full bobbin (cops) for an empty bobbin the full bobbin can be fitted onto the empty bobbin peg whilst thereafter an empty bobbin is removed from the bobbin peg of the other run associated with the same spinning point and fitted onto the spindle of the spinning point. In this known ring spinning machine as well the bobbin pegs are connected via angle pieces directly to the endless conveyor.

Problematical in the aforementioned ring spinning machines is firstly that the support pegs form a fixed part of the endless conveyor, which is necessary because the support pegs in the bobbin change position of the endless conveyor must be exactly aligned with the spinning point individually associated with them. For this reason, the full bobbins (cops) at the end of the last spinning point group must be removed from the support peg and then for example transferred to peg trays of a spooling frame. Conversely, the empty bobbins supplied for example from the spooling frame must be placed by means of special gripping and lifting means from the peg trays onto the support pegs at the start of the first spinning point group.

It is also already known (JP-OS 57-161 134) to use the peg trays employed in the spooling frame following the ring spinning machine also as empty bobbin supply means or full bobbin removal means by displacing said peg trays, which generally consist of a circular disc and a center peg arranged perpendicularly thereon, in a guide rail extending round the ring spinning machine, the diameter, in particular the length of a peg tray, being slightly smaller than the spacing of two adjacent spinning points. The individual peg trays are in contact with each other and are advanced by exerting a force on one or more peg trays, the thrust being at least partially transmitted by the direct contact of the peg trays. A conveying apparatus for such peg trays is also known from DE-OS 3,544,560.

A disadvantage in the ring spinning machine according to JP-OS 57-161 134 is that the bobbin pegs are not exactly in alignment with the spinning points when a group of peg trays with empty bobbins has been pushed on one machine side in front of the associated spinning points. Consequently, before the bobbin change can be performed in the known ring spinning machine a rake must be pushed at right-angles to the spinning machine longitudinal axis between the peg trays so that the intervals of the adjacent bobbin pegs are exactly coordinated with the intervals of the adjacent spinning stations.

In a similar bobbin transport means (DE-OS 3,712,027) a reciprocating rail or the like extending along the spinning points is used and cooperates with peg trays displaceable in a guide rail in such a manner that said trays are displaced stepwise up to the associated spinning point. To ensure that the peg trays are exactly aligned with the associated spinning point they must either have a length exactly equal to the spinning point spacing or blocking elements pivotal in pawl-like manner must be provided on the reciprocating rail and disposed exactly at the intervals of the spinning points so that the blocking elements ensure an exact alignment of the peg trays with the associated spinning point even when the holding trays are not in contact with each other.

Both the provision of a special aligning rake for the peg trays (JP-OS 62-191 524) and the arrangement of blocking pawls pivotal about an axis for each peg tray (DE-OS 3,712,027) require a complicated production and a considerable amount of space. The known arrangements are moreover trouble-prone and require maintenance.

The objective of the invention resides in providing a spinning machine, in particular a ring spinning machine or frame, in which in particular the same peg trays employed in the subsequent spooling frame can also be used for the supplying and removing of the bobbins in the spinning machine but nevertheless in the bobbin change position of the endless conveyor an exact alignment of the bobbin pegs relative to the associated spinning point or station is to be ensured without requiring for this complicated trouble-prone mechanical steps needing particular maintenance such as the introduction of rakes or the arrangement of pivotal pawls.

Briefly, the invention is directed to a ring spinning machine having at least one row of spinning positions or stations, an endless conveyor having at least one run disposed along the row of spinning stations, a plurality of drivers secured to the conveyor in spaced apart relation corresponding to a spacing between the spinning stations and a plurality of peg trays. In addition, each tray has a bobbin peg for receiving a bobbin thereon and each peg tray is releasably engaged with a selected one of the drivers for conveyance with the conveyor into a position aligned with a selected spinning station.

Basically, the invention resides in mounting on the endless conveyor in exact positioning drivers which need only be kept in entraining mechanical engagement with the peg trays in order to ensure in the bobbin change position of the endless conveyor an exact alignment of the bobbin pegs with the associated spinning position. This engagement is however automatically present when the peg trays have been conveyed by entraining to the spinning point. In this manner, for example, the peg trays usual in spooling frames can also be used for supplying and removing the bobbins in the ring spinning machine and an exact alignment of the support pegs with the spinning points is ensured without any excessive production and maintenance expenditure being necessary.

The attachment of the drivers to the endless conveyor in exact alignment can be carried out in the same manner as the known direct attachment of the support pegs to the endless conveyor; however, according to the invention the essential advantage is achieved that the peg trays need not be introduced into the guide rails until the loading station and brought into engagement with the circulating drivers. At the unloading station, the peg trays can readily be removed from the drivers whilst the exactly positioned drivers remain unchanged on the endless conveyor which is implemented in particular as a vertically arranged steel band or belt.

With the construction according to the invention it is also possible to replace a support peg or peg tray which has become defective by a perfect peg or tray without impairing the exact position ensured by the driver.

According to a first embodiment, it is possible to provide both runs of the endless conveyor on a single machine side and expediently both runs are equipped with drivers and peg trays.

It is however particularly preferred if the endless conveyor is led round two opposite machine sides of one or more spinning station groups so that in a single working operation, the full bobbins (cops) on both sides of the spinning machine can be replaced by empty bobbins.

In another embodiment, an auxiliary peg is mounted on each peg tray to receive an empty bobbin with a full bobbin on the peg of the peg tray. In this embodiment, it is possible firstly to deposit the empty bobbins on the auxiliary peg so that the bobbin peg is available for receiving the full bobbin. Thereafter, the empty bobbin can then be removed from the auxiliary peg and placed onto the spindle of the spinning point. To carry out this doffing operation, the endless conveyor can temporarily be advanced or moved back in suitable manner through half a spinning station interval. It is particularly advantageous to arrange the auxiliary pegs on the driver because this enables conventional peg trays to be used.

To facilitate the conveying of the auxiliary peg round the curved regions of the endless conveyor at the end of the spinning point group when the auxiliary pegs are arranged on the peg tray, the pegs are pivotally mounted on each peg tray and a guide is provided for guiding the auxiliary peg into a plane with the peg of the associated peg tray which is parallel to the row of spinning stations. Thus, the auxiliary peg can be held and guided in such a manner that in a bobbin change position, the auxiliary peg lies exactly in a line with the remaining pegs of the same spinning point group.

According to the invention the endless conveyor in accordance with one embodiment is used only for advancing but not for carrying the peg trays. For carrying the peg trays, a support rail is disposed to extend along the row of spinning stations for slidably supporting the peg trays thereon. In addition, the support rail may have a flange for guiding the peg trays longitudinally of the rail. In this case, the drivers have a pure drive function.

Further, the peg trays may be additionally guided by the drivers, for example by way of a snap connection with the drivers. Alternatively, the drivers may hold the peg trays in magnetic engagement.

The invention is used with particular advantage in combination with a following spooling frame, the peg trays provided in the spooling frame also performing the conveying of the bobbins in the spinning machine.

In this regard the peg trays guided in the spooling frame unsynchronized directly behind each other in groups are exactly positioned on transfer to the spooling frame in that in controlled manner they are brought successively into engagement with the exactly positioned drivers. Conversely, the peg trays after filling with a full bobbin at the end of the respective spinning position group are removed from their exact positioning on the endless conveyor and supplied to the normal transport system of the spooling frame which operates with a completely different time cycle to the ring spinning machine. Thus, there is no timing interface between the ring spinning machine and the spooling frame.

The invention idea in the combination of the spinning machine according to the invention, in particular ring spinning machine, with a following spooling frame is thus to be seen in that one and the same peg tray on the spinning machine can be brought with the simplest means, i.e. the exactly positioned drivers, into exact alignment with the individual spinning points whilst within the spooling frame the normal unsynchronized transport of consecutive peg trays takes place.

At the transition from the spinning machine to the spooling frame no grippers or the like at all are required because the support or guide rails of the spinning machine can merge directly into the conveying means of a buffer section or of the spooling frame.

The buffer section is expediently connected between the spinning machine and the spooling frame to take account of the somewhat different operating speeds of the two machines. On the buffer sections, a predetermined supply of full bobbins and empty bobbins which are arranged on peg trays are kept ready. Once a buffer section is full, the respective replenishing device can be disconnected for a certain period. Conversely, by suitable switching means, for example operating with light barriers, the supplied device can be temporarily switched off when no more supply bobbins are present on the buffer section. The further conveying of the peg trays on the buffer sections should expediently be in batches to avoid having to switch a motor on and off for each peg tray supplied.

This construction has particular advantages in the event of a defective spooling frame. For normally in the event of a defective spooling frame removal of the cops by hand is very complicated. It is practically impossible when time-critical signals are present unless specific program functions are created.

However, at the one buffer section the full cops may be removed from the bobbin peg. The peg trays are likewise removed from the buffer section, equipped with a new bobbin and thereafter again placed on the second buffer section. Due to the monitoring, peg trays with full cops are continuously replenished and the peg trays with empty bobbins again conveyed to the ring spool machine.

It is also possible to achieve with the buffer sections, which should be protected from fiber fly, that the full bobbins (cops) are substantially protected from fiber fly by rapid transfer to the buffer section. However, in this case, the buffer section at the output of the ring spinning machine should have a capacity approximately equal to the number of spinning points supplying it.

The gripperless transfer of the peg trays from the spinning machine to the spooling frame or the buffer section and vice-versa can be effected conveniently by providing suitable outlet means for transferring the peg trays equipped with full bobbins out of their exactly aligned position on the conveyor of the ring spinning machine into the spooling frame as well as inlet means for transferring peg trays equipped with empty bobbins from a purely transport position in a spooling frame into the exactly aligned position on the endless conveyor of the ring spinning machine.

Thus, it is essential for the exact positioning of the peg trays to be effected by the drivers only on the spinning machine but not on the spooling frame or on the buffer sections.

A particularly advantageous further development is that the drivers are arranged longitudinally adjustably on the endless conveyor. It is possible in this manner to adjust the drivers exactly even after installation of the endless conveyor into the ring spinning machine by first releasing them from the endless conveyor and then displacing them to and fro in the longitudinal direction of the machine until the bobbin pegs entrained by the driver are exactly aligned with the associated spinning point, whereupon the driver is again fixed on the endless conveyor, for example screwed tight.

Another possibility of achieving an exact alignment of the bobbin pegs with the associated spinning point even after mounting of the endless conveyor on the ring spinning machine resides in that the endless conveyor is divided into individual sections which are connectable by locks adjustable in length or locks of different length. Depending upon any misadjustment found after mounting the endless conveyor, locks of different length may be inserted between the sections until each bobbin peg is exactly aligned with the associated spinning point.

A further essential idea of the invention is thus to be seen in that an alignment of the drivers and thus of the bobbin pegs relatively to the associated spinning points can be carried out even after mounting of the endless conveyor.

Preferably, the endless conveyor consists of a vertically disposed steel band or belt which is led round deflection or guide rollers with vertical axes provided at the ends of a spinning point group.

Figure 2:
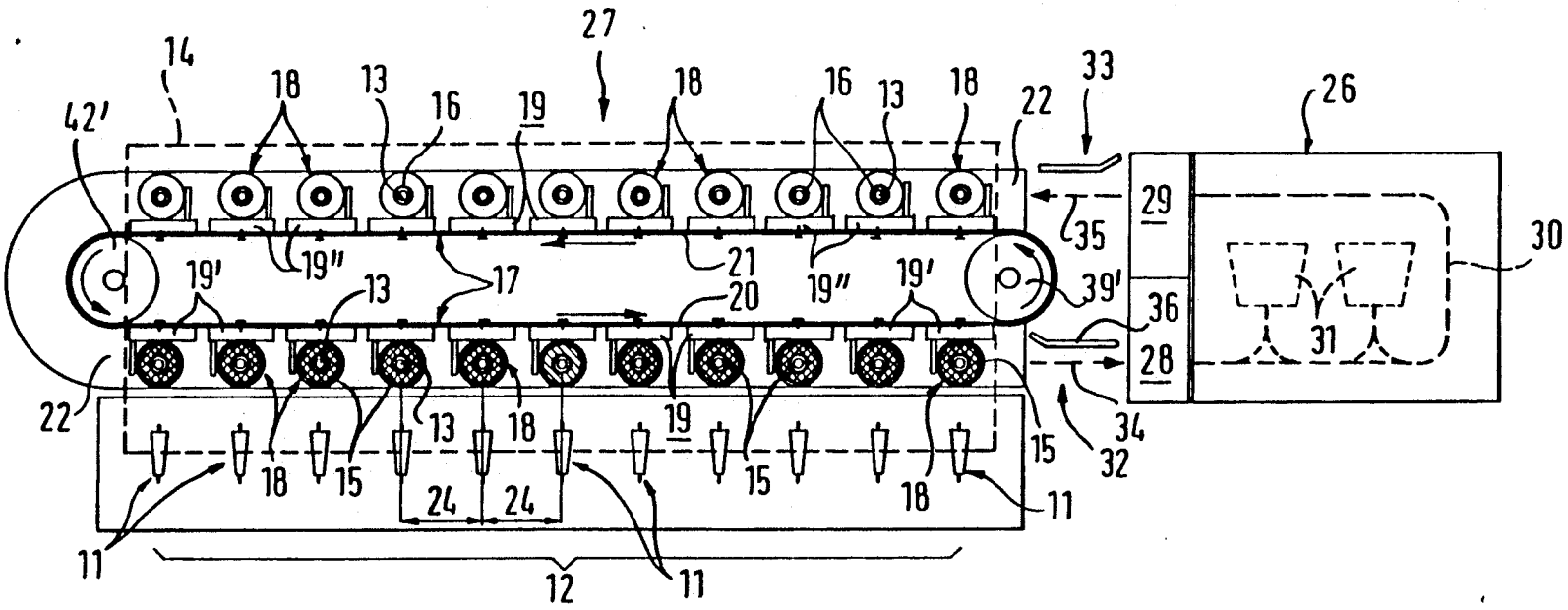
Figure 3:
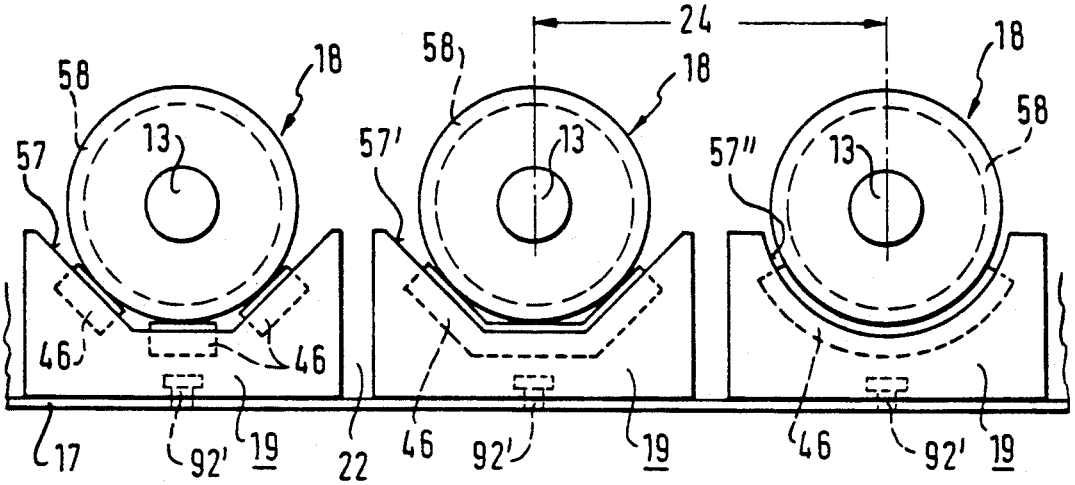
Figure 4:
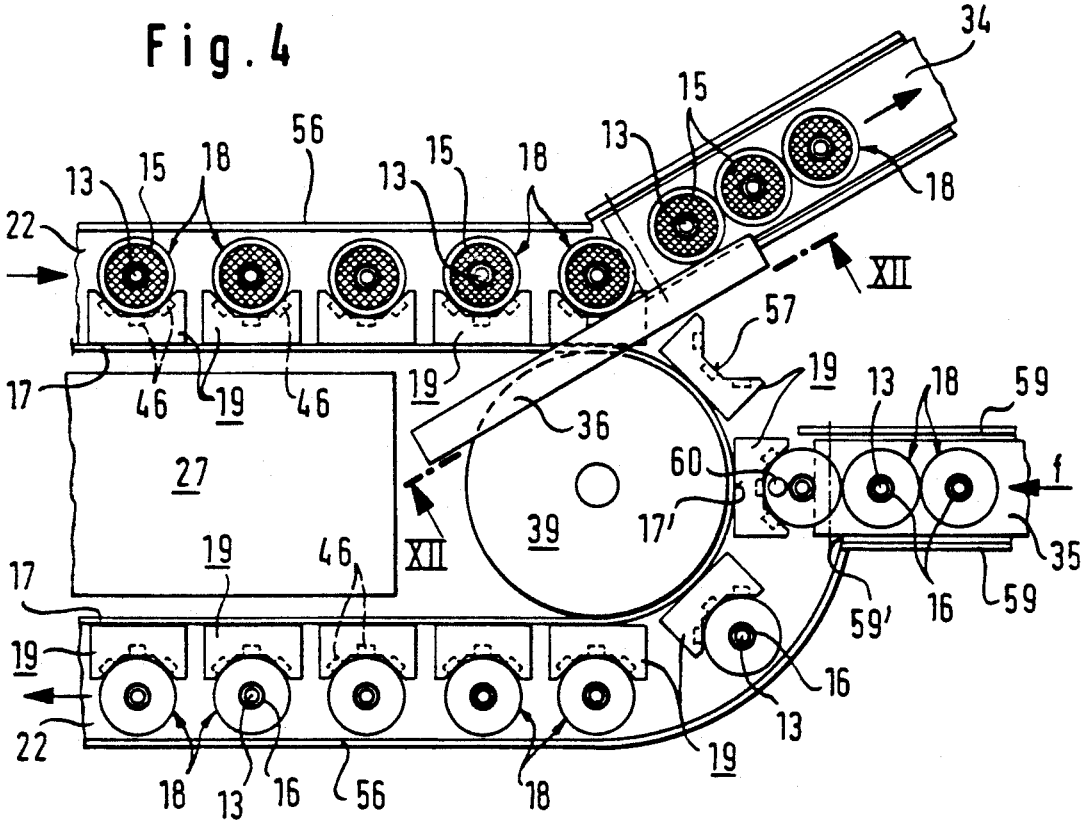
Figure 5:
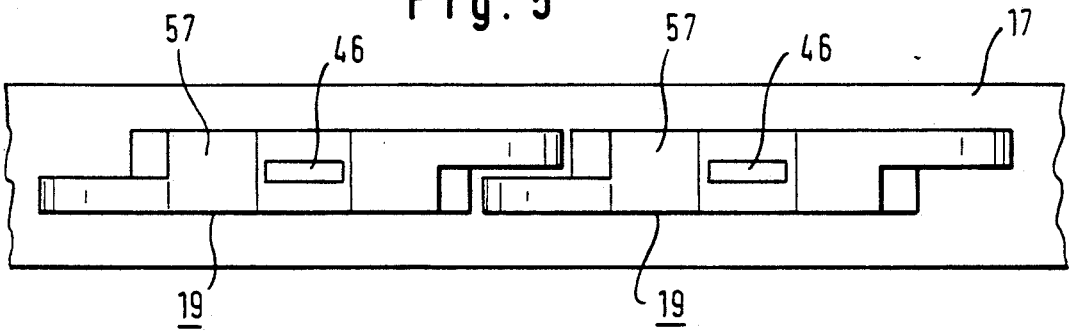
Figure 6:
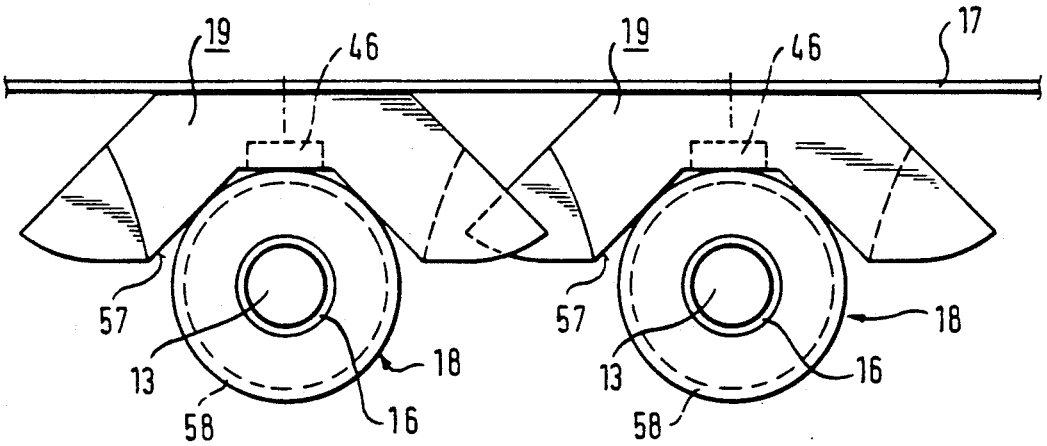
Figure 7:
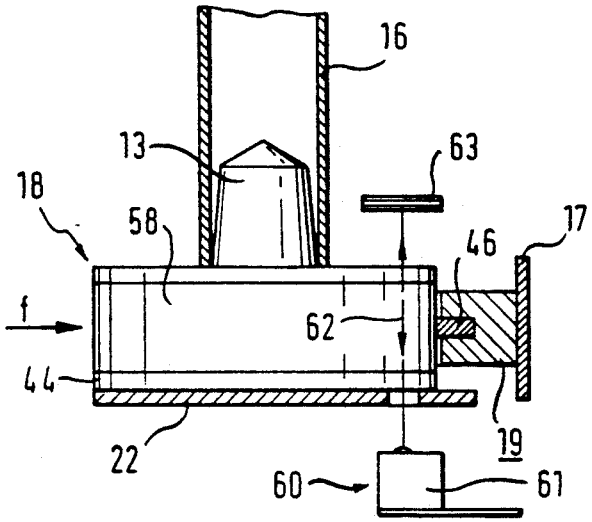
Figure 8:
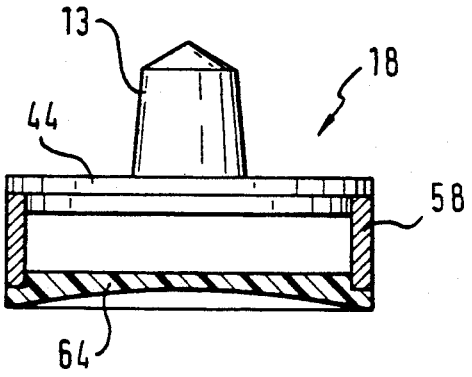
Figure 9:
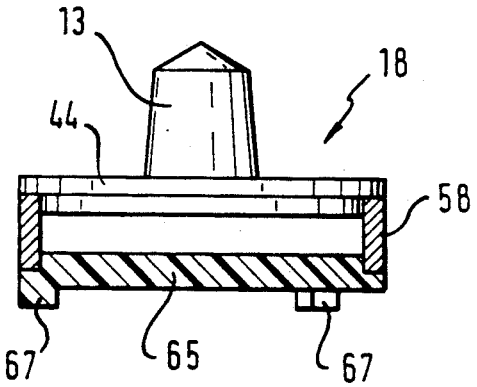
Figure 10:
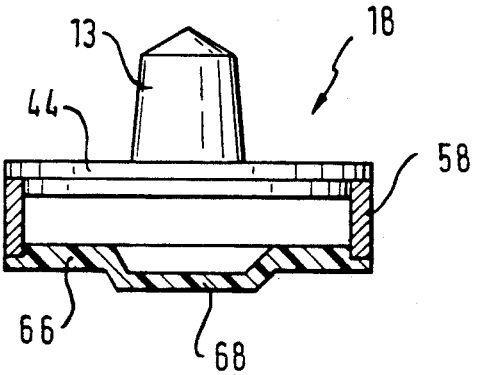
Figure 11:
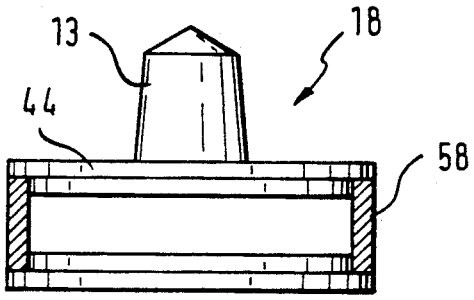
Figure 12:
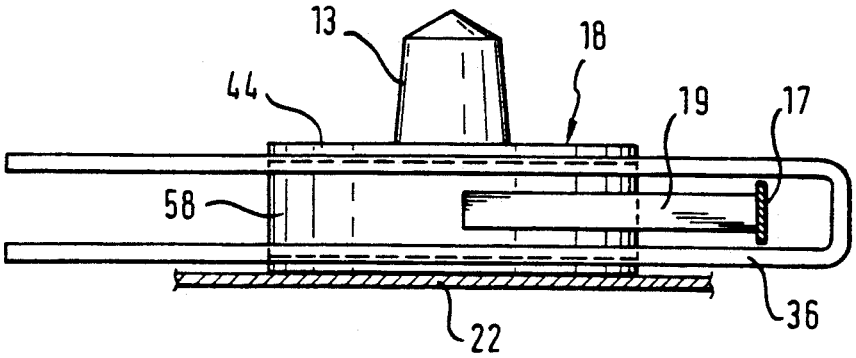
Figure 13:
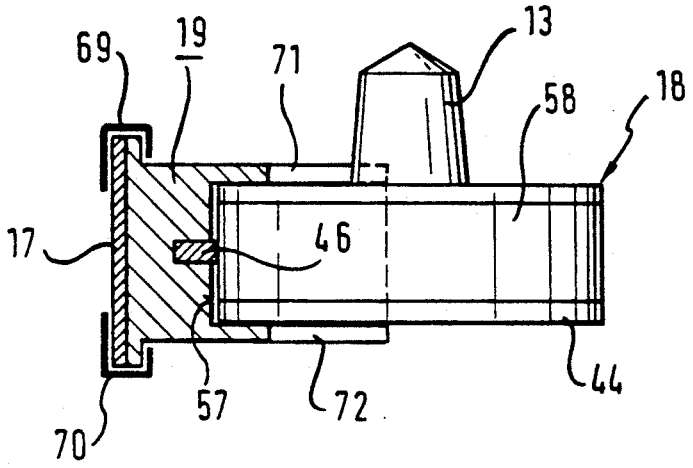
Figure 14:
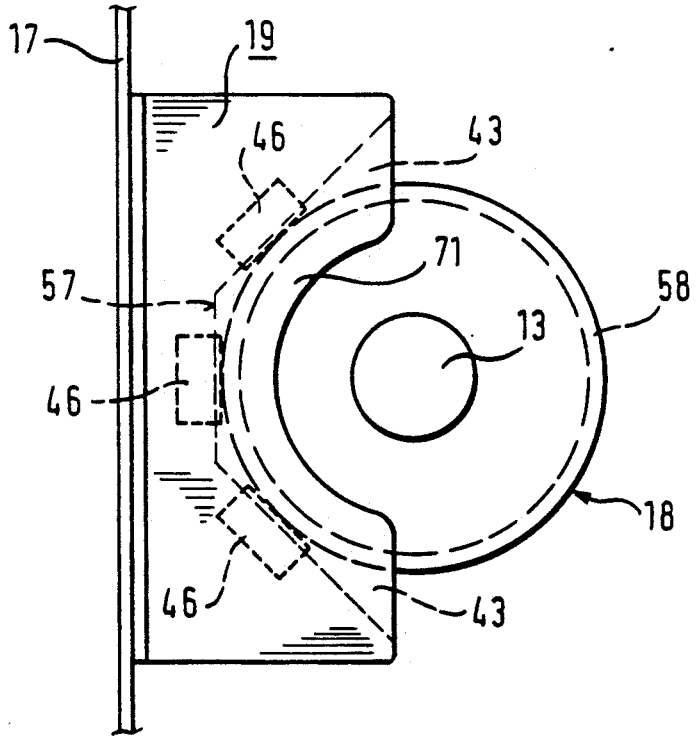
Figure 15:
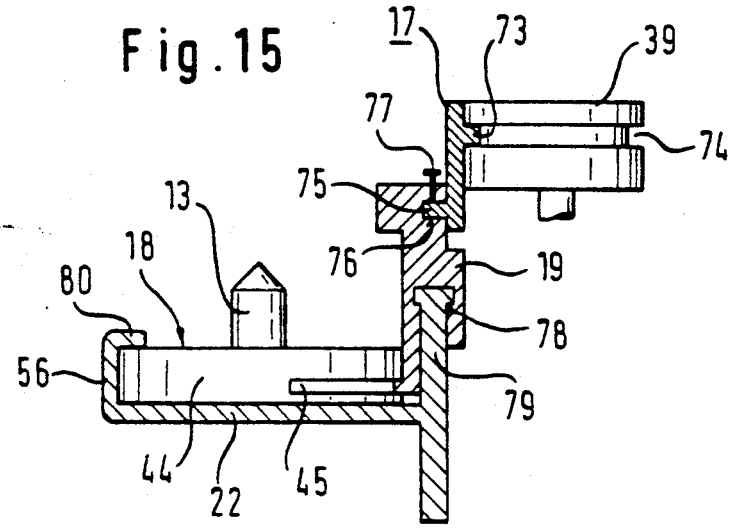
Figure 16:
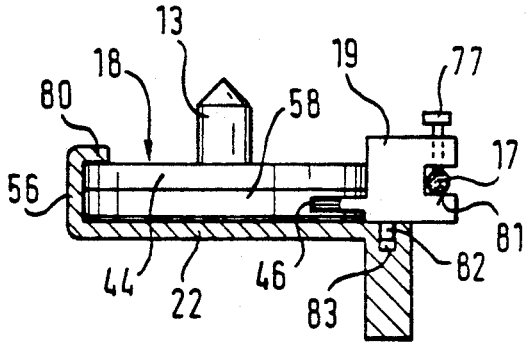
Figure 17:
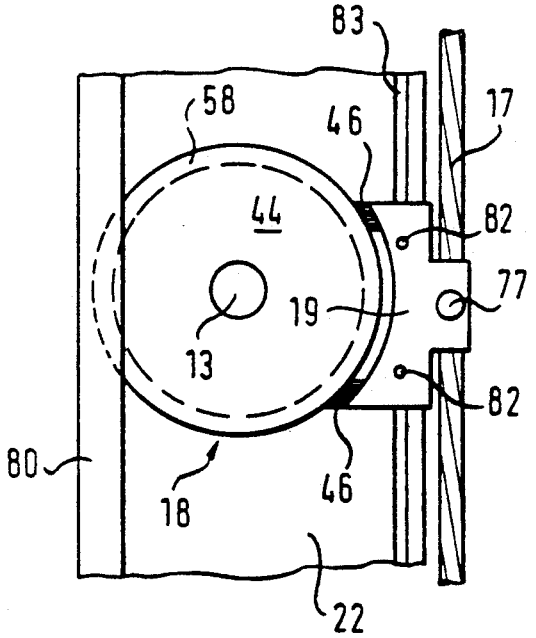
Figure 18:
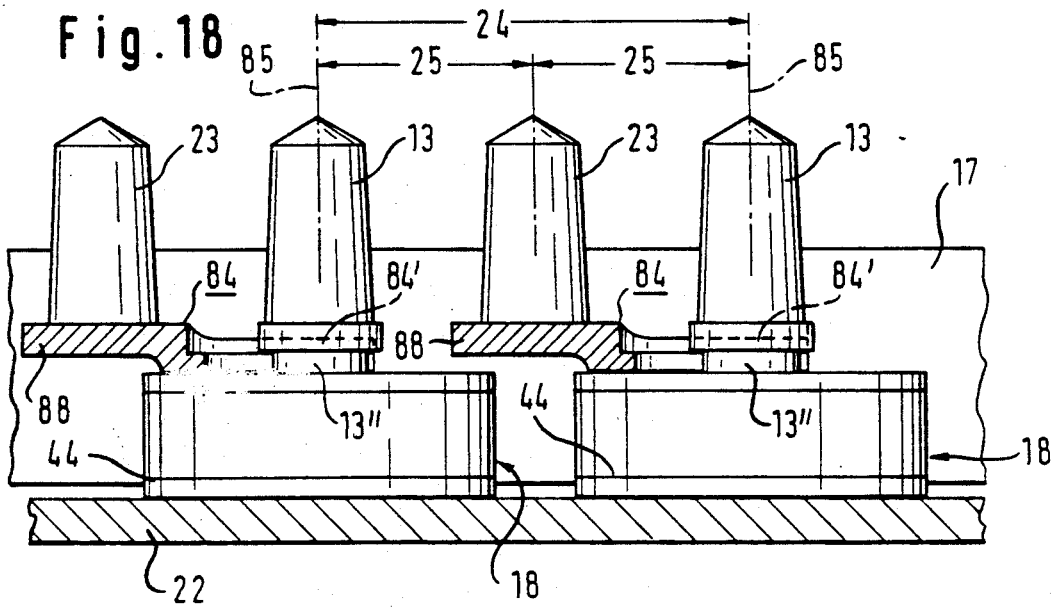
Figure 19:
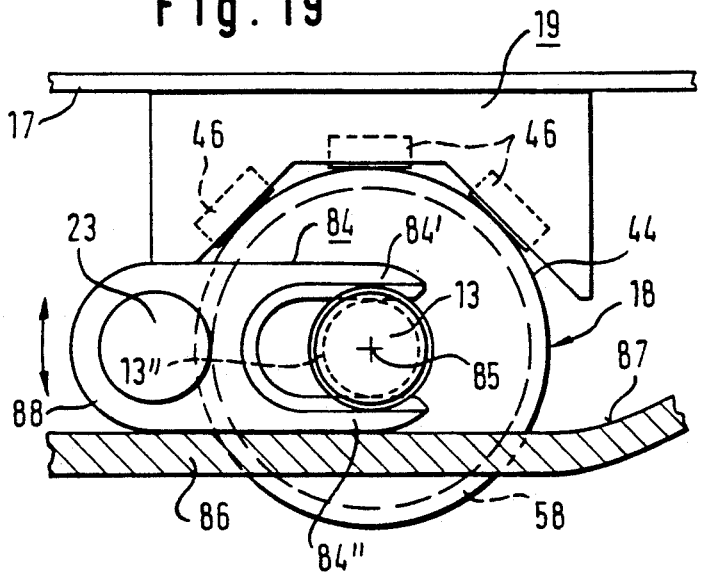
Figure 20:
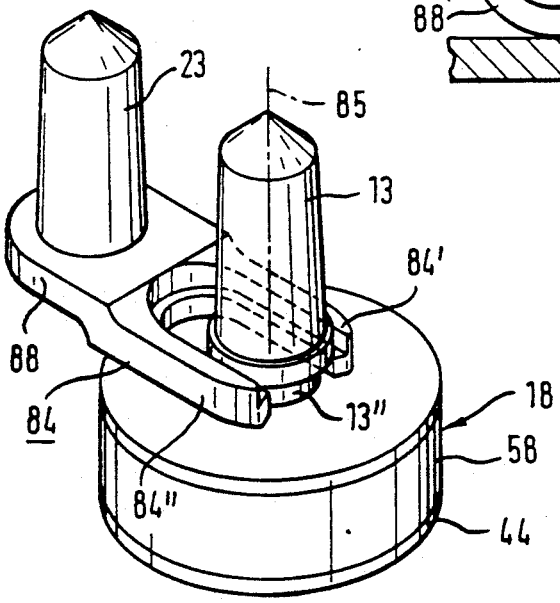
Figure 21:
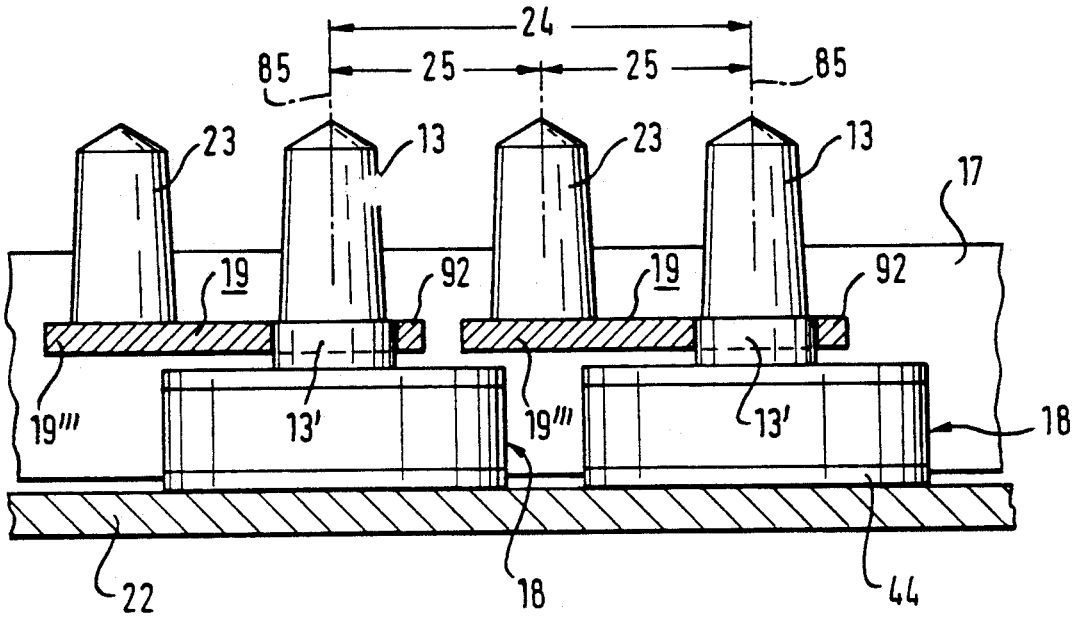
Figure 22:
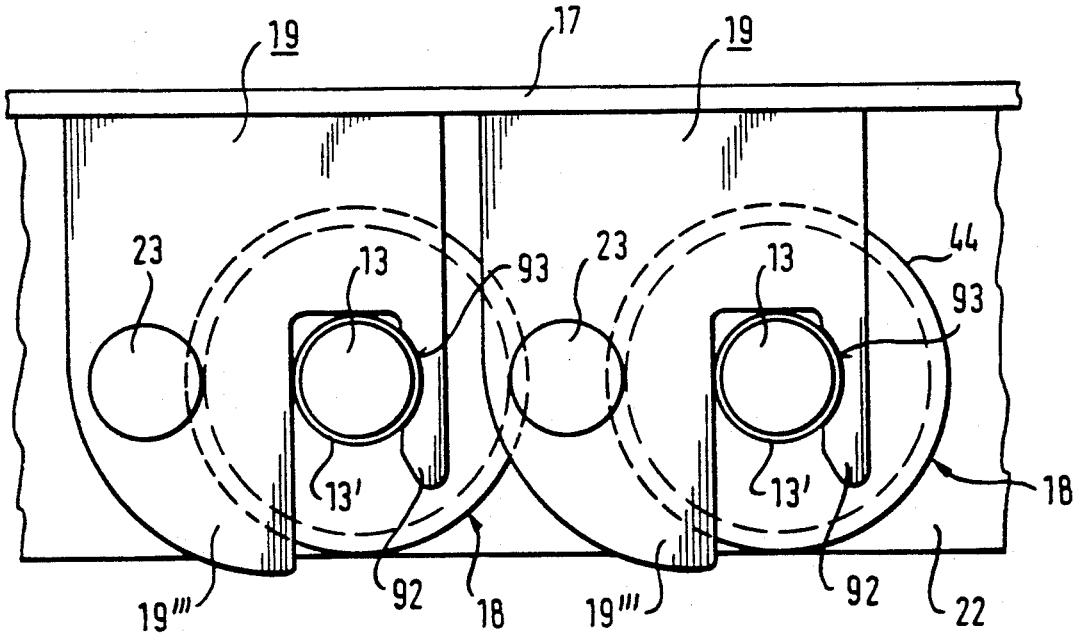
Figure 23:
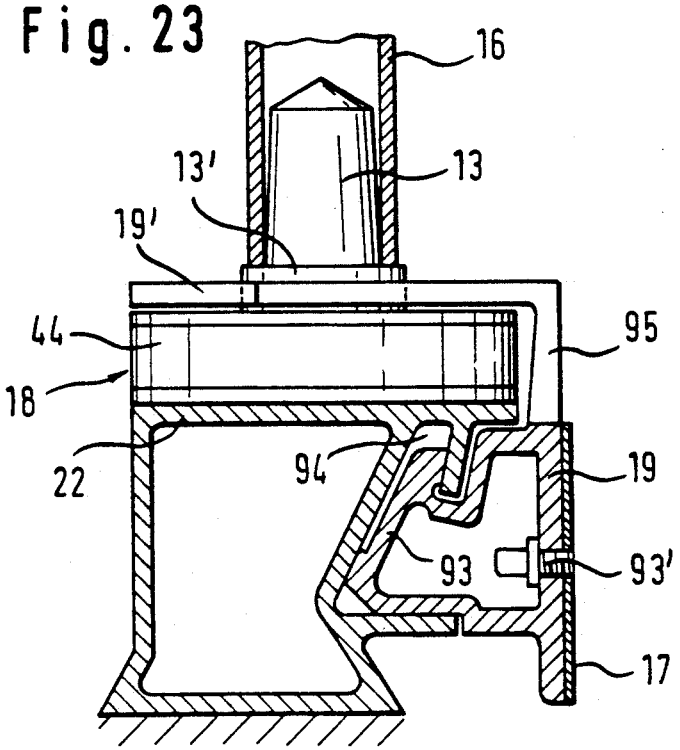
Figure 24:
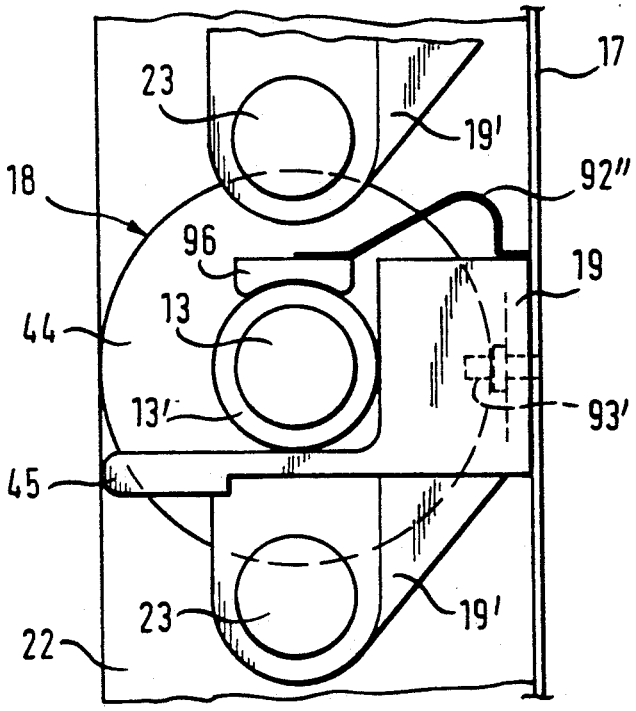

The invention will be described by way of example hereinafter with the aid of the drawings, wherein:

FIG. 1 is a schematic plan view of a ring spinning machine combined with a spooling frame and having an endless conveyor led round two spinning point groups arranged on different machine sides, FIG. 2 is a schematic plan view of another embodiment of a ring spinning machine according to the invention combined with a spooling frame, an endless conveyor being associated only with a spinning point group on one machine side, FIG. 3 is an enlarged partial plan view of an endless conveyor which is equipped with magnetic drivers and is fitted with peg trays, FIG. 4 is a schematic partial plan view of a ring spinning machine according to the invention in the region of an unloading or loading station at the end of a spinning point group, FIG. 5 is a view of an endless conveyor constructed as vertical steel belt with drivers fitted thereto and equipped with permanent magnets, FIG. 6 is a plan view of the subject of FIG. 5, FIG. 7 is a section through the endless conveyor with driver peg trays and guide rail as well as fitted empty bobbin, FIGS. 8, 9 and 10 are vertical sections of various peg trays equipped with magnetic material, FIG. 11 shows another embodiment of a peg tray in vertical section, FIG. 12 is a schematic side view along the line XII—XII of FIG. 4 to a somewhat larger scale, FIG. 13 is an enlarged section perpendicular to the conveying direction of a driver which is arranged on an endless conveyor, equipped with a peg tray and performs both a conveying and a guiding function, FIG. 14 is a plan view of the subject of FIG. 13, FIG. 15 is a cross-section perpendicular to the conveying direction of another embodiment of an endless conveyor with driver arranged thereon, guide rail and peg tray, FIG. 16 is a corresponding section through another embodiment in which the endless conveyor is a circulating wire cable, FIG. 17 is a plan view of the subject of FIG. 16, FIG. 18 is a side elevation of two consecutively arranged peg trays with a bobbin peg and an auxiliary peg, FIG. 19 is a plan view of a peg tray illustrated in FIG. 18, a lateral guide being additionally schematically indicated, FIG. 20 is a perspective view of a peg tray according to FIGS. 18 and 19, FIG. 21 is a front elevation of the endless conveyor with auxiliary pegs arranged on the drivers, FIG. 22 is a plan view of the subject of FIG. 21, FIG. 23 is a section perpendicular to the conveying direction of an endless conveyor with drivers disposed thereon, and FIG. 24 is a plan view of the subject of FIG. 23.

In accordance with FIG. 1 a ring spinning machine 27 comprises on opposite machine sides spinning point groups 12*a* and 12*b* which run parallel to each other and which each consist of only schematically indicated spinning points 11*a*, 11*b*, 11*c*, 11*d*, 11*e*, 11*f*, 11*g*, 11*h* and 11*i*, 11*k*, 11*l*, 11*m*, 11*n*, 11*o*, 11*p* and 11*q*. The spinning point interval, which is as constant as possible, is denoted by 24. Further details of the ring spinning machine 27, in particular the machine heads, are not shown because these are usual known arrangements. The number of spinning stations or points 11 has been shown greatly reduced for the sake of clarity.

An endless conveyor 17 in the form of a vertically extending steel band or belt is led round the two spinning point groups 12*a*, 12*b* and at the two ends of the spinning point groups 12*a*, 12*b* extending parallel and in alignment with each other is led round deflection or guide rollers 39, 40, 41, 42 with vertical axis. Thus, two long runs extending in each case along a spinning point group 12*a* and 12*b* and two short runs of the endless conveyor 17 connecting the two spinning point groups 12*a*, 12*b* at the ends are present.

On the conveyor 17 constructed as vertical steel band in alignment with the individual spinning points 11*a* to 11*q* drivers 19*a*, 19*b*, 19*c*, 19*d*, 19*e*, 19*f*, 19*g*, 19*h* and 19*i*, 19*k*, 19*l*, 19*m*, 19*n*, 19*o*, 19*p* and 19*q* extending outwardly from the endless conveyor 17 are provided. Immediately adjacent and beneath the endless conveyor 17 in the region of the spinning point groups 12*a*, 12*b* a horizontal support rail 22 extends which is also led about the left end of the ring spinning machine 27 parallel to the endless conveyor 17 to establish a transport connection between the two sides of the ring spinning machine.

Arranged at intervals apart on the support rail 22 engaging the drivers 19*a* to 19*h* and 19*i* to 19*q* are peg trays 18 which in accordance with FIG. 11 consist of a circular disc-shaped sliding body 44 and a bobbin peg arranged perpendicularly thereon, these parts preferably being made in one piece from plastic.

At the two spinning point groups 12*a* and 12*b* in each case two different constructions of drivers are illustrated. At the spinning point group 12*a* drivers 19*a* to 19*h* with mechanical driver fingers 45 engaging behind the peg trays 18 are provided whilst at the opposite spinning point group 12*b* drivers 19*i* to 19*q* are arranged at the endless conveyor 17 and contain permanent magnets 46 by means of which the peg trays 18 are held detachably in a manner described below with reference to FIG. 3.

At both machine sides in accordance with FIG. 1 bobbin change means 14 are indicated in dashed line and may be constructed as in the case of classic doffers and serve for removing full bobbins (cops) from the spindles of the spinning points 11 and in their place positioning empty bobbins 16 on the spindles which by means of the endless conveyor 17 have been brought up to the individual spinning points 11.

The deflection or guide rollers 41, 42 are connected together by means of a tensioning beam 47 held movably in the direction of the double arrows in the machine longitudinal direction, said beam being put under a bias tensioning the endless conveyor 17 by a tensioning means 48 supported at the machine frame.

At a suitable point, for example between the guide rollers 39, 40, in a manner not shown a cleaning station having blowing and suction nozzles and/or brushes may be provided for cleaning the drivers 19 and the conveyor belt 17 from fiber fly.

Furthermore, at any point of the endless conveyor 17 not occupied already by drivers 19 a cleaning element may be mounted for example in the form of a cleaning disc which on circulation of the endless conveyor 17 slides along the support rail 22 and thereby cleans the latter. Such a cleaning element may also be provided in all the examples of embodiment of the invention.

At the end of the spinning point groups 12*a*, 12*b* remote from the tensioning beam 47 buffer sections 28, 29 formed by conveyor belts 34, 35 are provided in alignment with the sections of the support rails 22 extending along the spinning points 11 which are followed by an only schematically indicated spooling frame 26 with guide rails 30 and spooling points 31. The number of spooling points 31 is at least one order of magnitude less than the number of spinning points 11.

In the region of the transfer from the upper support rail 22 in FIG. 1 to the conveyor belt 34 directly following the support rail 22 a deflector 36 is provided which engages the peg trays 18 in the region of the guide roller 39 and separates them from the drivers 19 led round the guide rollers 39 so that they move on to the conveyor belt 34 starting in the region of the guide roller 39.

In front of the lower guide roller 40 in FIG. 1 a conveyor belt 35 is likewise disposed and first guides peg trays 18 equipped with empty bobbins 16 to a retaining stop 37 which can be momentarily withdrawn by means of a drive means 50 controlled by a light barrier 49 for release of the particular frontmost peg tray 18. The conveyor belts 34, 35 are driven intermittently in controlled manner or continuously during a bobbin change process.

At the front end of the conveyor belt 35 the support rail 22 associated with the spinning point group 12*a* follows so that peg trays 18 released by the retaining stop 37 and equipped with empty bobbins 16 are pushed by the conveyor belt 35 onto the stationary support rail 22 and can be engaged there by the driver finger 45 of a driver 19.

At the beginning and end of each conveyor belt 34, 35 light barriers 51, 52, 53, 54 are provided which serve to detect the presence or absence of peg trays 18 at the respective point and accordingly control the mode of operation of the transport means of the ring spinning machine 27 or the spooling frame 26.

At the front end of the conveyor belt 34 a further mechanically insertable and withdrawable retaining stop 55 is provided which on a corresponding full bobbin requirement of the spooling frame 26 is temporarily withdrawn to allow a predetermined number of full bobbins 15 through to the spooling frame 26.

The mode of operation of the combination of a ring spinning machine with a spooling frame described is as follows:

In the position illustrated in FIG. 1 in front of each spinning point 11 there is a peg tray 18 equipped with an empty bobbin 16. As soon as the bobbins arranged on the spindles of the spinning points 11 have been fully wound with yarn the empty bobbins 16 disposed on the individual peg trays 18 are lifted off the support pegs 13 by the bobbin change means 14 and the full bobbins (cops) 15 disposed on the spindles of the spinning points are lifted off and replaced by the empty bobbins 16. The full bobbins 15 move onto the support pegs 13 of the associated peg trays 18. For clarity, intermediate pegs 23 (FIGS. 18 to 22) necessary for the bobbin exchange are not shown in FIG. 1.

As soon as the exchange of full bobbins 15 and empty bobbins 16 has been made the spinning operation on the ring spinning machine 27 is restarted and the endless conveyor 17 is set in operation in the direction of the arrow, whereupon the full bobbins 15 are successively transferred by the deflector 36 onto the conveyor belt 34 of the buffer section 28. At the other end of the conveyor belt 34 the spooling frame 30 calls up the necessary number of full bobbins 18 to establish the final large spools at the spooling points 31.

From the guide rail 30 of the spooling frame 26 the unwound empty bobbins with the peg trays 18 carrying them are placed on the conveyor belt 35 of the buffer section 29 and are successively conveyed up to the retaining stop 37. In this manner, just as on the conveyor belt 34, a row of directly adjacent peg trays 18 is formed which represent a reserve for the transfer to the endless conveyor 17.

As soon as a driver 19 with driver finger 45 comes into the position shown in dashed line in FIG. 1 directly in front of the guide roller 40 the light barrier 49 via the control line 49' indicated in dashed line and the drive means 50 frees the path for the leading peg tray 18 by momentarily withdrawing the retaining stop 37. The conveyor belt 35 thereupon shifts said peg tray up to the position 18' shown in dashed line in FIG. 1. In this position the peg tray is already on the stationary support rail 22. It now waits until the driver finger 45 of the driver 19 engages it and conveys it along the support rail 22 to the associated one of the spinning points 11*a* to 11*h* and 11*i* to 11*q* respectively.

Whereas in the embodiment of the drivers with permanent magnets 46 shown in the upper half of FIG. 1 a lateral guiding of the peg trays by the support rail 22 is not necessary because this is done by the permanent magents 46, in the embodiment with mechanical driver fingers shown in the lower part of FIG. 1 the support rail 22 also comprises a lateral guide 56.

Since the drivers 19 on the endless conveyor 17 in the bobbin change position shown in FIG. 1 are positioned exactly relatively to the individual spinning points 11 the peg trays 18 entrained by them and thus the support pegs 13 mounted on the peg trays 18 are also exactly aligned with the individual spinning points 11. The initially absent alignment is established on transfer from the conveyor belt 35 to the support rail 22 whereas on transfer of the full bobbins 15 from the upper support rail 22 to the transport belt 34 it is deliberately abandonned again because the operation now changes to the cycle of the spooling frame 26.

In the embodiment according to FIG. 2, in which identical reference numerals denote corresponding parts in FIG. 1, an endless conveyor 17 having two runs 20, 21 is arranged on one machine side along a spinning point group 12. In this embodiment the bobbin change means 14 changes the full bobbins arranged on the spindles of the spinning points 11 in that it first deposits the full bobbins 15 onto the support rail 22 disposed on the run 20 in the region of the exactly positioned drivers 19' and then, from the support rail 22 disposed on the run 21 remote from the machine in the region of the drivers 19'' likewise exactly positioned with respect to each spinning point, then removes an empty bobbin from the peg trays 18 disposed there and places said bobbin onto the spindles of the spinning points 11. After this change has been completed the endless conveyor 17 is switched on. It then conveys the full bobbins 15 successively via the conveyor belt 34 belonging to the buffer section 28 to the spooling frame 26 whilst the spooling frame 26 via the conveyor belt 35 belonging to the buffer section 29 delivers peg trays 18 with empty bobbins 16 to the run 21 of the endless conveyor 17 remote from the spinning points 11. In this manner, during the spinning operation at the spinning points 11 a complete set of full bobbins 15 can be carried away and a correspondingly complete set of empty bobbins 16 supplied to the individual spinning points or stations. At the end of the spinning operation, i.e. shortly before the bobbins fitted on the spindles are filled with yarn, only peg trays 18 equipped with empty bobbins 16 are on the run 21 whilst the run 20 is empty and thus ready to receive peg trays 18 equipped with full bobbins 15.

In FIG. 3 three constructional forms of drivers 19 mounted by means of screws 92' on the endless conveyor 17 are shown with various embodiments of the receiving openings 57 for the peg trays 18. Whereas the first driver 19 has a trough-like prismatic receiving opening 57 with three consecutively arranged separate permanent magnets 46, the prismatic trough-like opening 57' of the center driver 19 is equipped with a correspondingly prismatically shaped permanent magnet 46. The receiving opening 57'' of the third driver 19 illustrated is partially circular and is equipped with a correspondingly partially circularly shaped permanent magnet 46.

In accordance with FIG. 11 the sliding body 44 of the peg tray 18 is provided at the cylindrical peripheral surface with especially encircling inserts 58 of a soft magnetic material, for example steel, which in accordance with FIG. 3 come to lie partially opposite the permanent magnets 46 so that they are attracted by the latter and thereby the peg trays 18 are firmly held on the drivers 19 in a defined position. In accordance with FIGS. 4 and 12 peg trays 18 equipped with full bobbins 15 at the end of the ring spinning machine 17 or at the end of a spinning point group are separated from the drivers 19 by a deflector 36 against which the peg trays 18 run in the region of the guide-roller 39 and transferred to a conveyor belt 34 which is connected to the spool frame 26 (FIGS. 1, 2).

In accordance with FIG. 12 the deflector 36 is made stirrup-shaped so that the vertical steel conveyor band or belt 17 and the drivers 19 freed from the peg tray 18 can pass through the stirrup opening and thus reach the circulation roller 39 and be led round the latter.

In the conveying direction directly behind the deflector 36 the empty bobbin supply conveyor belt 35 is provided and supplies peg trays 18 equipped with empty bobbins 16 to the drivers 19 emptied at the deflector 36. The supply direction f is perpendicular to the apex 17' of the conveyor belt 17.

As soon as the leading peg tray 18 has been gripped by the associated driver 19 it is moved laterally out of the guide path 59 having a corresponding opening 59' for the peg trays 18 equipped with empty bobbins 16, whereupon via the conveyor belt 35 the row of peg trays 18 is advanced by one peg tray so that the following empty drivers 19 can be correspondingly equipped.

In accordance with FIGS. 5 and 6, adjacent drivers 19 may overlap so that between the drivers 19 no gap forms into which the peg trays 18 supplied via the conveyor belt 35 according to FIG. 4 could move. It is ensured in this manner that peg trays 18 supplied by the conveyor belt 35 of FIG. 4 consecutively to the endless conveyor 17 and equipped with empty bobbins 16 move successively into the receiving openings 57 of consecutive drivers 19 and are held fixed there by the permanent magnets 46.

With a light barrier 60 disposed over the leading peg trays 18 of the conveyor belt 35 it can be determined whether a peg tray 18 is present; if the light barrier 60 detects the absence of such a peg tray 18 at this point by suitable control means the endless conveyor 17 can be stopped until a peg tray 18 equipped with an empty bobbin 16 is supplied by the conveyor belt 35.

FIG. 7 shows in detail how such a light barrier 60 can be configured. A light transmitter-receiver 61 transmits a light beam 62 upwardly through the region in which a peg tray 18 should be disposed. Above this region a retro-reflector 63 is provided which in the absence of a peg tray 18 reflects light to the light transmitter-receiver 61 so that a corresponding absence signal can be initiated therein. If a peg tray 18 is disposed in the path of the light beam 62 no light will be reflected to the light transmitter-receiver 61 and consequently no absence signal activated at the light transmitter-receiver 61 so that the operation of the conveyor 17 need not be interrupted.

FIGS. 8 to 10 show various constructions of the bottom of the sliding body 44 of the peg trays 18 consisting of plastic. Since this bottom bears on the support rail 22 particularly good sliding properties are essential.

The bottom 64 made from easily slidable and resistant plastic is made dome-shaped according to FIG. 8 so that a sliding engagement on the support rail 22 is present only at the periphery.

The bottom 65 according to FIG. 9 has three downwardly projecting sliding projections 67 distributed uniformly over the outer periphery.

The bottom 66 according to FIG. 10 comprises in the center region a planar engagement projection 68 so that here the peg tray 18 comes into sliding engagement on the support rail 22 only in its center region.

FIGS. 13 and 14 show an embodiment in which the sliding body 44 of the peg trays 18 is held and guided solely by the drivers 19. For this purpose the drivers 19 are mounted on the vertically extending steel conveyor belt 17 which, preferably like the drivers 19 as well, is guided in machine-fixed upper and lower longitudinal guides 69 and 70 respectively in such a manner that the tilting moments about the conveying direction exerted by the peg trays 18 are also taken up by the guides 69, 70.

The drivers 19 are provided not only with the trough-shaped depressions 57 for receiving the periphery of the sliding bodies 44 but also with retaining stops 71, 72 engaging over the sliding bodies 44 from above and below. Since the permanent magnet 46 pulls the sliding bodies 44 into the thus formed receiving space 43 of the drivers 19 the peg trays 18 are connected in form-locking manner to the drivers 19 and thus to the conveyor belt 17, although they are releasable by the deflector 36 (FIG. 4).

In the example of embodiment according to FIG. 15 the vertical steel conveyor belt 17 comprises a tongue 73 which projects inwardly towards the guide roller 39 and engages into a peripheral groove 74 of the guide roller 39. The remaining guide rollers 40, 41, 42 have corresponding peripheral grooves 74. This step obtains perfect vertical alignment between the steel belt 17 and the guide rollers.

In the lower region the vertically disposed conveyor belt 17 comprises an outwardly projecting tongue 75 which engages, displaceably in the conveying direction, into a corresponding groove 76 of the driver 19. By schematically indicated clamp means 77 the driver 19 can be locked in various longitudinal positions relatively to the conveyor belt 17. In this manner a longitudinal adjustment of the dog or driver 19 relatively to the endless conveyor 17 is possible.

In its lower region the driver 19 comprises a T-shaped guide recess 78 by means of which it bears slidingly on a profile 79 complementary thereto and of T cross-section. The T-profile is fixedly connected to the support rail 22 and the lateral guide 56, i.e. fixed with respect to the machine. Due to this guiding of the drivers 19 the latter and the conveyor belt 17 is perfectly supported and guided between the guide rollers 39, 40, 41 42 in the vertical direction as well.

The cylindrical sliding body 44 of the peg trays 18 is slidingly mounted on the support rail 22 and is advanced by the driver finger 45 of the driver 19 when the endless conveyor 17 is set in circulation.

The lateral guides 56 are further bent at their upper end to form a guide edge 80 so that the sliding bodies 44 are secured from above against lifting and can only be moved in the desired conveying direction.

According to FIGS. 16 and 17 the endless conveyor 17 is formed by a circulating steel cable to which the drivers 19 provided with corresponding receiving grooves 81 are clamped in a desired longitudinal position by clamp means 77. In this manner as well the drivers 19 can be secured in longitudinally variable position to the endless conveyor 17. In this embodiment permanent magnets 46 are again provided and cooperate with a magnetic insert 58 at the periphery of the sliding body.

From the lower side of the driver 19 guide pins 82 fixed with respect to the driver extend downwardly into a longitudinal groove 83 of the support rail 22 and in cooperation with the lateral guiding flange 56 on the opposite side this ensures perfect longitudinal guiding of the peg trays 18.

According to FIGS. 18 to 20 the peg trays 18 may also be provided with an auxiliary peg 23 which is formed identically to the bobbin peg 13. For this purpose from the foot of the auxiliary peg 23 a connecting lug 84 extends to the foot of the bobbin peg 13, where it forks. The two fork arms 84', 84" engage round the foot of the bobbin peg 13 in a partial circle and are snapped resiliently into an encircling groove 13". In this manner a defined spacing is established between the bobbin peg 13 and the auxiliary peg 23, this spacing being equal to half the spacing 24 between to spinning points.

Due to the engaging of the foot of the bobbin peg 13 by the bifurcate ends 84', 84" of the connecting lug 84 the auxiliary peg 23 can also pivot about the center axis 85 of the bobbin peg 13 in the manner indicated by the double arrow in FIG. 19. The object of this pivotability is to enable the bobbin peg 13 and the auxiliary peg 23 to position themselves exactly one behind the other when arranged in a rectilinear guide 86 in the manner shown in FIG. 19 whilst on transition of the guide 86 to a curved region 87 relative pivoting is possible between the two pegs 13, 23 to enable the entire arrangement to be perfectly guided also over curved regions of the conveyor 17.

Since the auxiliary peg 23 is disposed exactly between two consecutive bobbin pegs 13, of which the sliding bodies 44 lie closely adjacent each other, the foot 88 of each auxiliary peg 23 overlaps the sliding body 44 of the immediately following peg tray 18, i.e. must be formed with corresponding vertical offsetting.

Whereas the bobbin pegs 13 serve to supply and remove empty bobbins 16 and full bobbins 15 respectively, the purpose of the auxiliary pegs 23 is to temporarily receive the empty of full bobbin during a bobbin change at a spinning point 11 so that it is superfluous to arrange such an auxiliary peg 23 on the spinning machine itself.

In accordance with FIG. 21 the auxiliary pegs 23 may also be provided on the drivers 19 which for this purpose engage in fork manner from the endless conveyor 17 round the support pegs 13 or their feet 13' so that behind each bobbin peg 13 a platform 19''' is formed on which the auxiliary peg 23 is disposed with half the division 25. In accordance with FIGS. 21 and 22 the auxiliary peg 23 is constructed identically to the bobbin pegs 13 and also has the same arrangement in the vertical direction.

To hold the peg trays 18 reliably from the front as well and eliminate lateral guiding, the feet 13' of the bobbin pegs 13 are held at the front by a spring arm 92 extending away from the endless conveyor 17 and having a rounded depression 93 which partially engages around the cylindrical foot 13' from the front and thus presses the foot 13' against the platform 19''' of the driver 19. As a result, the peg trays 18 need only be slidingly supported by the support rail 22 from below whilst all the other holding and guiding functions are performed by the drivers 19.

FIGS. 23 and 24 show a constructionally particularly preferred implementation of the invention. The support rail 22 is formed as a hollow guide profile extending in the longitudinal direction of the machine and having a planar upper sliding face which is arranged fixed with respect to the machine. The driver 19 mounted on the conveyor belt 17 is secured by means of a screw 93' to said endless conveyor 17 and guided all round on the support rail profile 22 by the engagement of a projection 93 into a cavity 94 of the support rail profile 22. This also stabilizes the movement of the endless conveyor 17 again constructed as vertically arranged steel band. The driver platform 19' extends rearwardly and outwardly from a vertically upwardly directed arm 95 above the upper surface of the sliding body 44 of the peg tray 18 in order to engage behind the foot 13' of the bobbin peg 13. A jaw 96 pressed via a leaf spring 92" against the foot 13' engages the bobbin peg 13 to the front so that the peg tray 18 is held and guided releasably all round and can be removed in the direction away from the endless conveyor 17.

A spinning point group 12 consists generally of 48 spinning points; 3 to 25 spinning point or station groups are combined to form a spinning machine. As shown the endless conveyor 17 runs along such a spinning machine and round the latter, i.e. an endless conveyor 17 is preferably not led round each individual spinning point group but round the entirety of all the spinning point groups.

We claim:

1. In a ring spinning machine, the combination comprising at least one row of spinning stations;

an endless conveyor having at least one run disposed along said row of spinning stations;

a plurality of drivers secured to said conveyor in spaced apart relation corresponding to a spacing between said spinning stations; and a plurality of peg trays, each tray having a bobbin peg for receiving a bobbin thereon and being releasably engaged with a selected one of said drivers for conveyance with said conveyor into a position aligned with a selected spinning station.

2. The combination as set forth in claim 1 which includes a pair of said rows of spinning stations on opposite sides of a machine frame, and wherein said conveyor has a pair of said runs parallel to said rows of spinning stations.

3. The combination as set forth in claim 1 wherein said conveyor has a pair of parallel runs disposed along said one row of spinning stations with one run for conveying empty bobbins to said stations and the other run for conveying full bobbins from said stations.

4. The combination as set forth in claim 1 which further comprises an auxiliary peg mounted on at least one peg tray to receive an empty bobbin with a full bobbin on said peg of said one peg tray.

5. The combination as set forth in claim 4 wherein said auxiliary peg is spaced from said peg of said one peg may a distance equal to half the spacing between two of said spinning stations.

6. The combination as set forth in claim 4 wherein said auxiliary peg is pivotally mounted on said peg of said one peg tray.

7. The combination as set forth in claim 6 which further comprises a guide for guiding said auxiliary peg into a plane with said peg parallel to said row of spinning stations.

8. The combination as set forth in claim 1 which further comprises an auxiliary peg support on each driver for supporting a respective auxiliary peg thereon.

9. The combination as set forth in claim 1 which further comprises a support rail extending along said row of spinning stations for slidably supporting said peg trays thereon.

10. The combination as set forth in claim 9 wherein said support rail has a flange for guiding said peg trays longitudinally of said rail.

11. The combination as set forth in claim 1 wherein each peg tray is magnetically engaged with a respective driver.

12. The combination as set forth in claim 1 wherein said conveyor is a vertically disposed endless steel belt having said drivers secured thereon in depending relation and which further comprises a longitudinally extending profile parallel to said row of spinning stations and slidably supporting said drivers thereon.

13. The combination as set forth in claim 12 wherein said profile has a T-shape and each driver has a T-shaped recess receiving each said driver.

14. The combination as set forth in claim 1 wherein each driver is longitudinally adjustably mounted on said conveyor.

15. In combination, a spooling frame having a transport means for conveying bobbins to and from a plurality of spooling stations;

a ring spinning machine adjacent said spooling frame and having at least one row of spinning positions, an endless conveyor with at least one run disposed along said row of spinning positions, and a plurality of drivers secured to said conveyor in spaced apart relation corresponding to a spacing between said spinning stations;

a plurality of peg trays each having a bobbin peg thereon, each peg tray being releasably engaged with a selected one of said drivers of conveyance with said conveyor;

outlet means for conveying said peg trays having full bobbins thereon from said conveyor of said ring spinning machine into said transport means of said spooling frame; and inlet means for conveying said peg trays with empty bobbins thereon from said transport means of said spooling frame to said conveyor of said ring spinning frame.

16. The combination as set forth in claim 15 wherein each of said outlet means and inlet means is a conveyor aligned between said conveyor of said ring spinning machine and said transport means, and which further comprises a first retaining stop at one end of said conveyor of said outlet means to releasably hold a row of peg trays thereon and a second stop at one end of said conveyor of said inlet means to releasably hold a row of peg trays thereon.

17. The combination as set forth in claim 16 which further comprises a deflector at one end of said outlet means for disengaging successive peg trays from said conveyor of said ring spinning frame onto said conveyor of said outlet means.

* * * * *

UNITED STATES PATENT AND TRADEMARK OFFICE

CERTIFICATE OF CORRECTION

PATENT NO. : 5,185,993

DATED : February 16, 1993

INVENTOR(S) : Isidor Fritschi, et. al.

It is certified that error appears in the above-indentified patent and that said Letters Patent is hereby corrected as shown below:

Column 14, line 42, change "of" (second occurrence) to --for--

Signed and Sealed this

Eleventh Day of January, 1994

*Attest:*

*Attesting Officer*

BRUCE LEHMAN

*Commissioner of Patents and Trademarks*